US012723600B2

(12) United States Patent
Aoi et al.

(10) Patent No.: US 12,723,600 B2
(45) Date of Patent: Sep. 1, 2026

(54) FAN UNIT

(71) Applicant: Nidec Corporation, Kyoto (JP)

(72) Inventors: Hideki Aoi, Kyoto (JP); Yuta Yamasaki, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 0 days.

(21) Appl. No.: 18/519,246

(22) Filed: Nov. 27, 2023

(65) Prior Publication Data

US 2024/0175448 A1 May 30, 2024

(30) Foreign Application Priority Data

Nov. 30, 2022 (JP) ..... 2022-191636

(51) Int. Cl.

| | |
|---|---|
| ***F04D 29/66*** | (2006.01) |
| ***F04D 19/00*** | (2006.01) |
| ***F04D 25/06*** | (2006.01) |
| ***F04D 25/16*** | (2006.01) |
| ***F04D 29/52*** | (2006.01) |

(52) U.S. Cl.

CPC ..... *F04D 29/668* (2013.01); *F04D 19/002* (2013.01); *F04D 25/06* (2013.01); *F04D 25/166* (2013.01); *F04D 29/522* (2013.01)

(58) Field of Classification Search

CPC ..... F04D 29/688; F04D 29/646; F04D 29/66; H05K 7/20172; H05K 7/20581

See application file for complete search history.

(56) References Cited

U.S. PATENT DOCUMENTS

| | | | | |
|---|---|---|---|---|
| 5,788,467 | A * | 8/1998 | Zenitani | H05K 7/20581 417/423.5 |
| 7,054,155 | B1 * | 5/2006 | Mease | H05K 7/20581 165/104.34 |
| 2002/0094282 | A1 * | 7/2002 | Bendikas | F04D 25/166 417/423.5 |
| 2004/0005810 | A1 * | 1/2004 | Chang | H05K 7/20836 439/485 |
| 2019/0082558 | A1 * | 3/2019 | Sun | G06F 1/20 |

FOREIGN PATENT DOCUMENTS

CN 201363316 Y * 12/2009

* cited by examiner

*Primary Examiner* — Thomas Fink

(74) *Attorney, Agent, or Firm* — Keating & Bennett, LLP

(57) ABSTRACT

A fan assembly includes axial fans, a connector, a chassis portion, and a first vibration-proof portion. The axial fans are arranged in a first direction intersecting the rotation axis extending in the axial direction. The connector is closer to one side of the first direction with respect to the axial fans, and electrically connects the axial fans and an external device. The chassis portion accommodates the axial fans and the connector. The first vibration-proof portion is located on an outer surface of an end portion on the one side in the first direction of the chassis portion, and protrudes outward.

10 Claims, 2 Drawing Sheets

FAN UNIT

CROSS-REFERENCE TO RELATED APPLICATIONS

The present application claims priority under 35 U.S.C. § 119 to Japanese Patent Application No. 2022-191636, filed on Nov. 30, 2022, the entire contents of which are hereby incorporated herein by reference.

1. FIELD OF THE INVENTION

The present disclosure relates to a fan assembly.

2. BACKGROUND

Conventionally, a fan assembly that is accommodated in a housing of an electronic device and cools a heat generator inside is known. For example, a fan assembly having a plurality of axial fans is detachably electrically connected to a wireless communication device. The axial fans are arranged side by side in a direction intersecting the air blowing direction, and are sandwiched between the back surface of a chassis and a bracket. An intake port corresponding to each axial fan is provided in the back surface. The bracket and a substrate are fixed to the bottom surface of the chassis. An exhaust port corresponding to each axial fan is provided in the bracket. A plurality of connectors and a power supply connector are disposed on the substrate. The connectors are disposed between the axial fans adjacent to each other, and are electrically connected to the axial fans. The power supply connector is connected to a connection plug on the indoor unit (IDU) side of the wireless communication device by inserting and attaching the fan assembly to the wireless communication device.

However, conventionally, the axial fans are held by the chassis to which the substrate is fixed. In addition, a pair of guide pieces arranged on both sides in the width direction of the power supply connector disposed on the substrate is slidably connected along both side surfaces of the lower piece of the connection plug on the IDU side of the wireless communication device. For this reason, vibration generated in the axial fans is transmitted to the power supply connector and the connection plug, which may adversely affect the connection therebetween.

SUMMARY

A fan assembly according to an example embodiment of the present disclosure includes a plurality of axial fans, a connector, a chassis portion, and a first vibration-proof portion. The plurality of axial fans are arranged in a first direction intersecting a rotation axis extending in the axial direction. The connector is located on one side in the first direction with respect to the plurality of axial fans, and electrically connects the plurality of axial fans and an external device. The chassis portion accommodates the plurality of axial fans and the connector. The first vibration-proof portion is located on an outer surface of an end portion on one side in the first direction of the chassis portion, and protrudes outward.

The above and other elements, features, steps, characteristics and advantages of the present disclosure will become more apparent from the following detailed description of the example embodiments with reference to the attached drawings.

DETAILED DESCRIPTION

Figure 1:
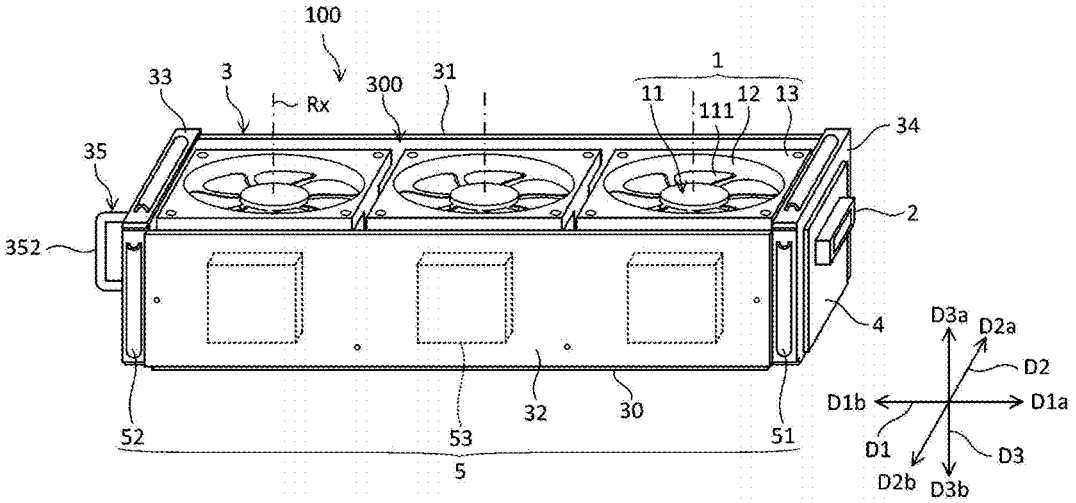
FIG. 1 is an external view illustrating an example configuration of a fan assembly according to the present example embodiment.

Hereinafter, example embodiments of the present disclosure will be described with reference to the drawings.

In the present specification, in a fan assembly 100, a direction parallel to a rotation axis Rx of an axial fan 1, to be described later, is referred to as an "axial direction".

In addition, a direction from one of a third side wall portion 33 and a substrate holding wall portion 34, to be described later, to the other is referred to as a "first direction D1". Of the first directions D1, a direction from the third side wall portion 33 to the substrate holding wall portion 34 is referred to as "one first direction D1*a*", and a direction from the substrate holding wall portion 34 to the third side wall portion 33 is referred to as "the other first direction D1*b*".

Further, a direction from one of a first side wall portion 31 and a second side wall portion 32, to be described later, to the other is referred to as a "second direction D2". Of the second directions D2, a direction from the second side wall portion 32 to the first side wall portion 31 is referred to as "one second direction D2*a*", and a direction from the first side wall portion 31 to the second side wall portion 32 is referred to as "the other second direction D2*b*".

Further, a direction from one of an opening 300 and a bottom wall portion 30, to be described later, to the other is referred to as a "third direction D3". Of the third directions D3, a direction from the bottom wall portion 30 to the opening 300 is referred to as "one third direction D3*a*", and a direction from the opening 300 to the bottom wall portion 30 is referred to as "the other third directions D3*b*".

In the example embodiment of the present specification, the third direction D3 is parallel to the axial direction. However, this example does not exclude a configuration in which the second direction D2 is not parallel to the axial direction. The first direction D1, the second direction D2, and the third direction D3 are orthogonal to each other.

Further, a direction perpendicular to a predetermined direction or an axis is referred to as a "radial direction (with reference to the predetermined direction or the axis)". Of the radial directions, a direction approaching a "predetermined direction or axis" serving as a reference is referred to as "radially inward (with reference to the predetermined direction or the axis)", and a direction away from a "predetermined direction or axis" serving as a reference is referred to as "radially outward (with reference to the predetermined direction or the axis)". Further, a rotation direction around a direction perpendicular to a predetermined direction or an axis is referred to as a "circumferential direction (with reference to the predetermined direction or the axis)".

In a positional relationship between any one and another one of azimuths, lines, and surfaces, "parallel" includes not only a state in which the two endlessly extend without intersecting at all but also a state in which the two are substantially parallel. In addition, "perpendicular" and "orthogonal" include not only a state in which both of them intersect each other at 90 degrees, but also a state in which they are substantially perpendicular and a state in which they are substantially orthogonal. That is, the terms "parallel", "perpendicular", and "orthogonal" each include a state in which the positional relationship between both has an angular deviation that does not depart from the gist of the present disclosure.

It is to be noted that the above names are used merely for description, and are not intended to limit actual positional relationships, directions, names, and the like.

Figure 2:
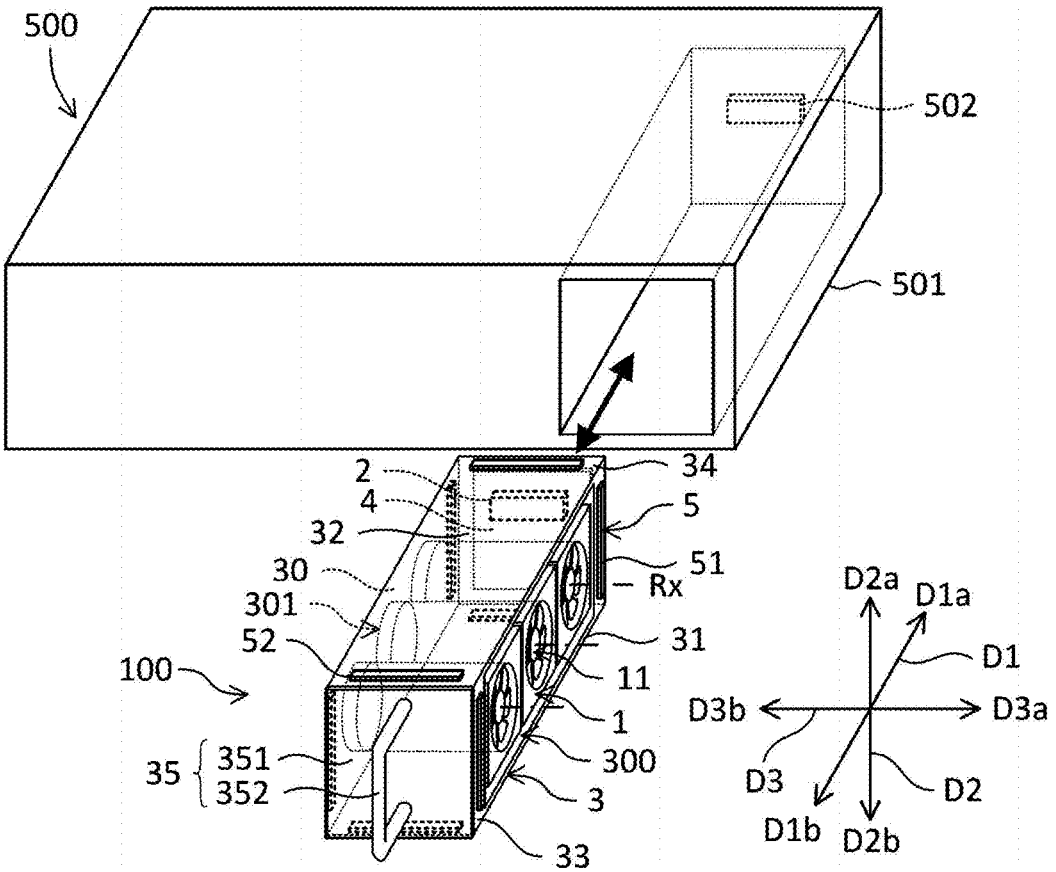
FIG. 2 is a schematic diagram illustrating a mounting example of the fan assembly.
Figure 3:
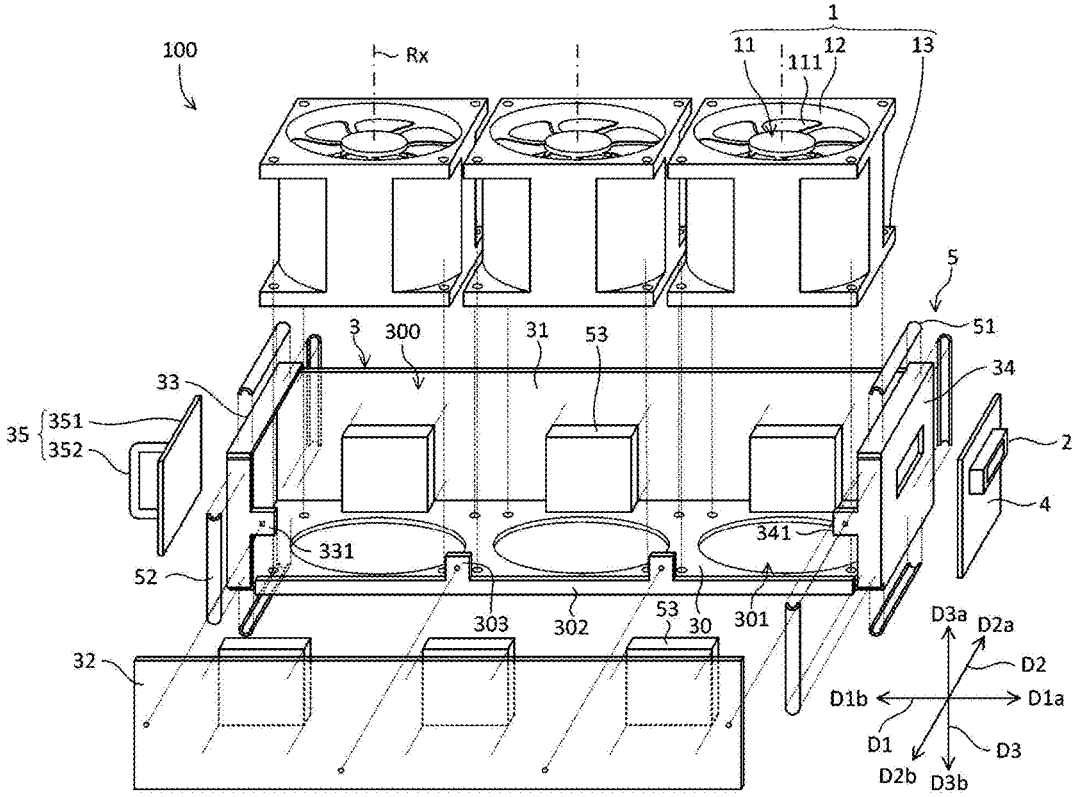
FIG. 3 is an exploded perspective view of the fan assembly.

FIG. 1 is an external view illustrating an exemplary configuration of the fan assembly 100 according to the present example embodiment. FIG. 2 is a schematic diagram illustrating a mounting example of the fan assembly 100. FIG. 3 is an exploded perspective view of the fan assembly 100.

As illustrated in FIG. 2, the fan assembly 100 is a blower that air-cools the inside of an external device 500, and is detachably disposed with respect to a housing 501 of the external device 500. The external device 500 is, for example, an information device such as a computer, or an electric device such as a communication device.

As illustrated in FIGS. 1 and 3, the fan assembly 100 includes a plurality of axial fans 1, a connector 2, a chassis portion 3, a substrate 4, and a vibration-proof portion 5.

The plurality of axial fans 1 are arranged in the first direction D1 intersecting the rotation axis Rx extending in the axial direction. As described above, the fan assembly 100 includes the plurality of axial fans 1. In the present example embodiment, the first direction D1 is a direction perpendicular to the axial direction and the rotation axis Rx.

Each axial fan 1 includes an impeller 11, a motor (not illustrated), a housing 12, and a flange portion 13. The impeller 11 includes a rotor blade 111 rotatable in a circumferential direction around the rotation axis Rx. The motor (not illustrated) drives the impeller 11 to rotate the rotor blades 111. The housing 12 has a tubular shape extending in the axial direction and accommodates the impeller 11 and the motor therein. The flange portion 13 is disposed at least at an end portion on the other D3*b* side of both end portions in the third direction D3 of the housing 12, and expands radially outward with respect to the rotation axis Rx. The flange portion 13 is fastened to the bottom wall portion 30 of the chassis portion 3 using, for example, a bolt. The outer shape of the flange portion 13 viewed from the axial direction is rectangular.

The connector 2 is disposed closer to the one first direction D1*a* side than the plurality of axial fans 1, and electrically connects the plurality of axial fans 1 and the external device 500. As described above, the fan assembly 100 includes the connector 2. The connector 2 is electrically connected to each axial fan 1 via a lead wire (not illustrated) such as a power supply line and a control signal line drawn from each axial fan 1. In addition, the connector 2 is electrically connected to a connector connection portion 502 of the external device 500 when the fan assembly 100 is inserted into the housing 501 of the external device 500.

The chassis portion 3 accommodates the plurality of axial fans 1 and the connector 2. As described above, the fan assembly 100 includes the chassis portion 3. The chassis portion 3 includes the bottom wall portion 30, the first side wall portion 31, the second side wall portion 32, an attachment portion 303, the third side wall portion 33, the substrate holding wall portion 34, and a grip part 35. The chassis portion 3 is a box body surrounded by the bottom wall portion 30, the first side wall portion 31, the second side wall portion 32, the third side wall portion 33, and the substrate holding wall portion 34. The chassis portion 3 further includes the opening 300 that opens in the one third direction D3*a*.

The bottom wall portion 30 is a plate-like member extending in the first direction D1 and the second direction D2. The plurality of axial fans 1 are fixed to the bottom wall portion 30. In other words, the bottom wall portion 30 is disposed on the ventilation port (for example, an intake port or an air supply port) side of the plurality of axial fans 1, and extends in a direction intersecting the rotation axis Rx of each axial fan 1. As described above, the chassis portion 3 includes the bottom wall portion 30. The bottom wall portion 30 has an opening 301 connected to the ventilation port of each axial fan 1. A plurality of openings 301 are arranged in the first direction D1. Each opening 301 penetrates the bottom wall portion 30 in the third direction D3, and is connected to the ventilation port of each axial fan 1 on a one-to-one basis. However, the present disclosure is not limited to this example, and one opening 301 may be connected to two or more (including all) ventilation ports of the axial fans 1.

The first side wall portion 31 is disposed in the one second direction D2*a* with respect to the plurality of axial fans 1, and extends in the axial direction parallel to the rotation axis Rx and the first direction D1. Here, the one second direction D2*a* side is an example of "one side in a fourth direction" of the present disclosure. In the present example embodiment, the first side wall portion 31 is integrated with the bottom wall portion 30, and extends from an end portion on the one second direction D2*a* side of the bottom wall portion 30 in the one third direction D3*a*. In the present example embodiment, the first side wall portion 31 is disposed to face the second side wall portion 32 in the second direction D2.

The second side wall portion 32 is arranged in the other second direction D2*b* with respect to the plurality of axial fans 1, and extends in the axial direction parallel to the rotation axis Rx and the first direction D1. Here, the other second directions D2*b* side is an example of "the other side in the fourth direction" in the present disclosure. In the present example embodiment, the second side wall portion 32 is a plate-like member that is a different body from the bottom wall portion 30. An end portion of the second side wall portion 32 on the one first direction D1*a* side is fixed to an end portion of the substrate holding wall portion 34 on the other second direction D2*b* side. An end portion of the second side wall portion 32 on the other first direction D1*b* side is connected to an end portion of the third side wall portion 33 on the other second direction D2*b* side, and specifically, is fixed to the attachment portion 331 of the third side wall portion 33. An end portion of the second side wall portion 32 on the one first direction D1*a* side is connected to an end portion of the substrate holding wall portion 34 on the other second direction D2*b* side, and specifically, is fixed to the attachment portion 341 of the substrate holding wall portion 34. An end portion of the second side wall portion 32 on the other third direction D3*b* side is connected to an end portion of the bottom wall portion 30 on the other second direction D2*b* side, and specifically, is fixed to the attachment portion 303 of the bottom wall portion 30. At least one of the attachment portions 331 and 341 may be omitted. For these fixing methods, screwing may be used, or rivets, caulking, or the like may be used.

Note that the present disclosure is not limited to the above example, and the first side wall portion 31 may be a plate-like member that is a different body from the bottom wall portion 30. Alternatively, both the first side wall portion 31 and the second side wall portion 32 may be plate-like members that are different bodies from the bottom wall portion 30. That is, at least one of the first side wall portion 31 and the second side wall portion 32 may be a different body from the bottom wall portion 30 and attached to an end portion in the second direction D2 of the bottom wall portion 30. Here, the second direction D2 is an example of a "fourth direction" of the present disclosure. In this way, a third vibration-proof portion 53, to be described later, can be more easily disposed between the axial fan 1 and the chassis portion 3.

Each of the attachment portions 303, 331, and 341 is a plate-shaped protruding piece. At least one of the first side wall portion 31 and the second side wall portion 32 (that is, a member that is a different body from the bottom wall portion 30) is attached to each of the attachment portions 303, 331, and 341. As described above, the chassis portion 3 includes the attachment portions 303, 331, and 341. At least one of the attachment portions (that is, the attachment portion 303) extends in the axial direction (for example, the one third directions D3*a*) from an end portion in the second direction D2 of the bottom wall portion 30. Here, the second direction D2 is an example of the "fourth direction" of the present disclosure. Another attachment portion 331 extends from the third side wall portion 33 in the one first direction D1*a*. Still another attachment portion 341 extends from the substrate holding wall portion 34 in the other first direction D1*b*.

In the present example embodiment, the extending plate part 302 extends in the one third direction D3*a* from a part of an end portion of the bottom wall portion 30 on the other second direction D2*b* side, and spreads in the first direction D1. The attachment portion 303 extends in the one third direction D3*a* from a part of an end portion of the extending plate part 302 on the one third direction D3*a* side. The extending plate part 302 may be omitted. In that case, a part of the attachment portion 303 extends in the one third direction D3*a* from a part of an end portion of the bottom wall portion 30 on the other second direction D2*b* side. Further, a single attachment portion 303 extending from the extending plate part 302 or the bottom wall portion 30 may be disposed, or a plurality of attachment portions 303 may be disposed side by side in the first direction D1.

In this way, it is easy to attach at least one of the first side wall portion 31 and the second side wall portion 32 (that is, a side wall portion that is a different body from the bottom wall portion 30) to the bottom wall portion 30. Therefore, the workability of assembling the fan assembly 100 can be improved.

Preferably, the attachment portion 303 extending from the bottom wall portion 30 overlaps the space between the housings 12 of the axial fans 1 adjacent to each other in the first direction D1, when viewed from the second direction D2. Note that, the second direction D2 in this example embodiment is an example of a "fourth direction" of the present disclosure. More preferably, the attachment portion 303 extending from the bottom wall portion 30 is disposed in the other third direction D3*b* with respect to the flange portion 13 on the one third direction D3*a* side. Accordingly, contact between the axial fan 1 and the attachment portion 303 can be suppressed. Therefore, it is possible to prevent transmission of vibration from the axial fan 1 to the chassis portion 3 via the attachment portion 303. However, this example does not exclude a configuration in which at least some of the attachment portions 303 extending from the bottom wall portion 30 do not overlap the space between the housings 12 of the axial fans 1 adjacent to each other in the first direction D1.

The third side wall portion 33 is disposed in the other first direction D1*b* with respect to the plurality of axial fans 1, and extends in a direction intersecting the first direction D1. As described above, the chassis portion 3 includes the third side wall portion 33.

The substrate holding wall portion 34 extends in a direction intersecting the first direction D1 at an end portion of the chassis portion 3 on the one first direction D1*a* side, and holds the substrate 4. An end portion of the substrate holding wall portion 34 on the one second direction D2*a* side is fixed to an end portion of the first side wall portion 31 on the one first direction D1*a* side. An end portion of the substrate holding wall portion 34 on the other second direction D2*b* side is fixed to the second side wall portion 32 as described above. These fixing methods may be screwing, riveting, or caulking.

The grip part 35 is disposed at an end portion of the third side wall portion 33 on the other first direction D1*b* side. Specifically, the grip part 35 includes a plate 351 and a handle 352. The plate 351 extends in a direction intersecting the first direction D1, and is disposed on an end surface of the third side wall portion 33 on the other first direction D1*b* side. An end surface of the plate 351 on the one first direction D1*a* side is in contact with an end surface of the third side wall portion 33 on the other first direction D1*b* side. The handle 352 is disposed closer to the other first direction D1*b* side than the third side wall portion 33 at an end portion of the chassis portion 3 on the other first direction D1*b* side. The fan assembly 100 includes the handle 352. The handle 352 is fixed to an end surface of the plate 351 on the other first direction D1*b* side. However, the present disclosure is not limited to this example, and the plate 351 may be omitted, and the handle 352 may be fixed to an end surface of the third side wall portion 33 on the other first direction D1*b* side.

The substrate 4 is disposed at an end portion of the chassis portion 3 on the one first direction D1*a* side, and extends in a direction intersecting the first direction D1 (for example, the second direction D2 and the third direction D3). On the substrate 4, the connector 2, a drive circuit of each axial fan 1, and the like are mounted.

Next, the vibration-proof portion 5 is a generic term for members that are disposed inside and outside the chassis portion 3 to suppress transmission of vibration. The vibration-proof portion 5 includes a first vibration-proof portion 51, a second vibration-proof portion 52, and a third vibration-proof portion 53. As each vibration-proof portion 5, a leaf spring, foam such as sponge and urethane foam, or an elastic member such as rubber can be adopted. In the present example embodiment, leaf springs are adopted for the first vibration-proof portion 51 and the second vibration-proof portion 52, and urethane foam is adopted for the third vibration-proof portion 53. However, this example does not exclude a configuration in which an elastic member other than the above-described members is adopted as at least one of the first vibration-proof portion 51 to the third vibration-proof portion 53.

The first vibration-proof portion 51 is disposed on an outer surface of an end portion of the chassis portion 3 on the one first direction D1*a* side, and protrudes outward. The fan assembly 100 includes the first vibration-proof portion 51. The above-described outer surface is a radial outer surface with reference to the first direction D1. The outer side described above is a radially outer side with reference to the rotation axis Rx. In the present example embodiment, the above-described outer surface includes at least one of an end surface on the one D2*a* side and an end surface on the other D2*b* side in the second direction D2, and an end surface on the one D3*a* side and an end surface on the other D3*b* side in the third direction D3.

With such a configuration, the first vibration-proof portion 51 can be disposed in the vicinity of the connector 2. Therefore, when the fan assembly 100 is accommodated in the housing 501 of the external device 500, the first vibration-proof portion 51 disposed on the outer surface of the chassis portion 3 can suppress transmission of vibration from the plurality of axial fans 1 to the connector 2 via the chassis portion 3. Therefore, it is possible to suppress an adverse effect of the vibration on the connection between the connector 2 and the external device 500. For example, it is possible to suppress connection failure between the two or disconnection between the two.

In addition, by disposing the first vibration-proof portion 51 on the outer surface of an end portion on the one first direction D1*a* side of the chassis portion 3, when the fan assembly 100 is inserted into the housing 501 of the external device 500 from the end portion on the one first direction D1*a* side, abutment between the chassis portion 3 and the housing 501 of the external device 500 can be suppressed. Therefore, the fan assembly 100 can be smoothly inserted into the housing 501 of the external device 500.

Preferably, the number of the first vibration-proof portions 51 is plural, and they are disposed on at least either an end surface on the one D2*a* side and an end surface on the other D2*b* side in the second direction D2, or an end surface on the one D3*a* side and an end surface on the other D3*b* side in the third direction D3, among outer surfaces of end portions on the one first direction D1*a* side of the chassis portion 3. As described above, the second direction D2 is perpendicular to the first direction D1. The third direction D3 is perpendicular to the first direction D1 and the second direction D2.

More preferably, the first vibration-proof portions 51 are disposed on the above-described four surfaces as in the present example embodiment (see FIG. 1 and the like). The number of the first vibration-proof portions 51 disposed on each surface may be one or plural.

Thus, at least one of the second direction D2 component and the third direction D3 component of the vibration transmitted to the connector 2 can be effectively suppressed.

However, the above-described examples do not exclude a configuration in which the number of the first vibration-proof portions 51 is one, a configuration in which the first vibration-proof portion 51 is arranged only on either an end surface on the one D2*a* side or an end surface on the other D2*b* side in the second direction D2, and a configuration in which the first vibration-proof portion 51 is arranged only on either an end surface on the one D3*a* side or an end surface on the other D3*b* side in the third direction D3.

Preferably, in the first direction D1, at least a part of the first vibration-proof portion 51 is disposed at the same position in the first direction D1 as the connector 2. Here, "at least a part of the first vibration-proof portion 51" may be a part of one first vibration-proof portion 51, or may be at least one of a plurality of first vibration-proof portions 51. In other words, at least a part of the first vibration-proof portion 51 overlaps the connector 2 when viewed from at least one of the second direction D2 and the third direction D3.

With such a configuration, the first vibration-proof portion 51 can be disposed in the vicinity of the connector 2. Therefore, the vibration-proof effect of the connector 2 can be improved.

However, this example does not exclude a configuration in which at least a part of the first vibration-proof portion 51 is not disposed at the same position in the first direction D1 as the connector 2 in the first direction D1. For example, in the first direction D1, all of the first vibration-proof portions 51 may be arranged in the one first direction D1*a* or the other first direction D1*b* with respect to the connector 2, and may not overlap the connector 2 when viewed from both the second direction D2 and the third direction D3.

Next, the second vibration-proof portion 52 is disposed on an outer surface of an end portion of the chassis portion 3 on the other first direction D1*b* side, and protrudes outward. The fan assembly 100 further includes the second vibration-proof portion 52. The above-described outer surface is a radial outer surface with reference to the first direction D1. The outer side described above is a radially outer side with reference to the rotation axis Rx. In the present example embodiment, the above-described outer surface includes at least one of an end surface on the one D2*a* side and an end surface on the other D2*b* side in the second direction D2, and an end surface on the one D3*a* side and an end surface on the other D3*b* side in the third direction D3.

In this way, since the vibration-proof portions 51 and 52 can be disposed at the end portions on both sides in the first direction D1 of the chassis portion 3, it is possible to prevent the chassis portion 3 from abutting on the housing 501 of the external device 500. Therefore, transmission of vibration from the fan assembly 100 to the housing 501 of the external device 500 can be more effectively suppressed.

Preferably, the plurality of second vibration-proof portions 52 are disposed on at least either an end surface on the one D2*a* side and an end surface on the other D2*b* side in the second direction D2, or an end surface on the one D3*a* side and an end surface on the other D3*b* side in the third direction D3, among outer surfaces of end portions of the chassis portion 3 on the other first direction D1*b* side. As described above, the second direction D2 is perpendicular to the first direction D1. The third direction D3 is perpendicular to the first direction D1 and the second direction D2.

More preferably, the second vibration-proof portions 52 are disposed on the above-described four surfaces as in the present example embodiment (see FIG. 1 and the like). The number of the second vibration-proof portions 52 disposed on each surface may be one or plural.

With this configuration, at least one of the second direction D2 component and the third direction D3 component of the vibration transmitted from an end portion on the other D1*b* side in the first direction of the chassis portion 3 to the housing 501 of the external device 500 can be effectively suppressed.

However, the above-described examples do not exclude a configuration in which the number of the second vibration-proof portions 52 is one, a configuration in which the second vibration-proof portion 52 is disposed only on either an end surface on the one D2*a* side or an end surface on the other D2*b* side in the second direction D2, and a configuration in which the second vibration-proof portion 52 is disposed only on either an end surface on the one D3*a* side or an end surface on the other D3*b* side in the third direction D3.

Preferably, in the first direction D1, at least a part of the second vibration-proof portion 52 is disposed at the same position in the first direction D1 as the third side wall portion 33. More preferably, in the first direction D1, at least a part of the first vibration-proof portion 51 is disposed at the same position in the first direction D1 as the connector 2 as described above, and at least a part of the second vibration-proof portion 52 is disposed at the same position in the first direction D1 as the third side wall portion 33. Here, "at least a part of the second vibration-proof portion 52" may be a part of one second vibration-proof portion 52 or may be at least one of a plurality of second vibration-proof portions 52. In other words, at least a part of the second vibration-proof portion 52 overlaps the third side wall portion 33 when viewed from at least one of the second direction D2 and the third direction D3. Here, the same applies to "at least a part of the first vibration-proof portion 51", as described above.

Accordingly, when the user grips the handle 352 and inserts the fan assembly 100 into the housing 501 of the external device 500, contact between the housing 501 and the fan assembly 100 can be more effectively suppressed.

However, this example does not exclude a configuration in which at least a part of the second vibration-proof portion 52 is not disposed at the same position in the first direction D1 as the connector 2, in the first direction D1. For example, in the first direction D1, all of the second vibration-proof portions 52 may be disposed in the one first direction D1*a* or the other first direction D1*b* with respect to the third side wall portion 33, and may not overlap the third side wall portion 33 when viewed from both the second direction D2 and the third direction D3.

Next, at least a part of the third vibration-proof portion 53 is disposed between the axial fan 1 and the chassis portion 3 in the second direction D2. The fan assembly 100 further includes the third vibration-proof portion 53. The second direction D2 here is an example of the "fourth direction" of the present disclosure, and is a direction perpendicular to the axial direction of the axial fan 1 and the first direction D1. In this way, even if the interval between the axial fan 1 and the chassis portion 3 is narrow in the second direction D2, transmission of vibration from the axial fan 1 to the chassis portion 3 can be suppressed by the third vibration-proof portion 53. In addition, since the above-described interval does not need to be sufficiently wide, the fan assembly 100 can be downsized.

Preferably, the third vibration-proof portions 53 are disposed at least between the axial fan 1 and the first side wall portion 31 and between the axial fan 1 and the second side wall portion 32. At this time, the third vibration-proof portion 53 may be fixed to either the axial fan 1 or the chassis portion 3 (an end surface of the first side wall portion 31 on the other second direction D2*b* side, an end surface of the second side wall portion 32 on the one second direction D2*a* side), and may be in contact with or face the other with an interval. Alternatively, the third vibration-proof portion 53 may be fixed to both the axial fan 1 and the chassis portion 3.

Thus, the third vibration-proof portions 53 are disposed on both sides of the axial fan 1 in the second direction D2. Therefore, as compared with a configuration in which the third vibration-proof portion 53 is disposed only on one side in the second direction of the axial fan 1, transmission of vibration from the axial fan 1 to the chassis portion 3 can be sufficiently suppressed. In addition, since the interval does not need to be sufficiently wide, the fan assembly 100 can be downsized.

However, this example does not exclude a configuration in which the third vibration-proof portion 53 is not disposed at least either between the axial fan 1 and the first side wall portion 31 or between the axial fan 1 and the second side wall portion 32.

More preferably, a part of the vibration-proof portion 5 (not illustrated) may be disposed at least either between the axial fan 1 and the third side wall portion 33 or between the axial fan 1 and the substrate holding wall portion 34. Therefore, it is possible to prevent transmission of vibration from the axial fan 1 to the chassis portion 3. However, this example does not exclude a configuration in which some of the vibration-proof portions 5 are not disposed between the axial fan 1 and the third side wall portion 33 and between the axial fan 1 and the substrate holding wall portion 34.

Note that the above-described example does not exclude a configuration in which the vibration-proof portion 5 to be disposed inside the chassis portion 3 is omitted. For example, at least one of the third vibration-proof portion 53 and the above-described other vibration proof-members may be omitted.

In addition, some other vibration-proof portions 5 (not illustrated) may be disposed on at least one of an end surface of the first side wall portion 31 on the one second direction D2*a* side and an end surface of the second side wall portion 32 on the other second direction D2*b* side. Therefore, it is possible to further prevent transmission of vibration from the axial fan 1 to the chassis portion 3. However, this example does not exclude a configuration in which some other vibration-proof portions 5 are not disposed on both an end surface of the first side wall portion 31 on the one second direction D2*a* side and an end surface of the second side wall portion 32 on the other second direction D2*b* side.

Further, the connector 2 may protrude from the substrate 4 toward the one first direction D1*a* side. When viewed from the first direction D1, the connector 2 may have a long side and a short side. In that case, the shortest distance (interval) between the first vibration-proof portion 51 and the long side of the connector 2, as viewed from the first direction D1, may be shorter than the shortest distance (interval) between the first vibration-proof portion 51 and the short side of the connector 2. Thus, vibration in a direction perpendicular to the long side of the connector 2 can be effectively suppressed.

The example embodiments of the present disclosure have been described above. It is to be noted that the scope of the present disclosure is not limited to the above-described example embodiments. The present disclosure may be implemented by adding various modifications to the above-described example embodiments within a range not departing from the spirit of the disclosure. In addition, the matters described in the above-described example embodiments are arbitrarily combinable together as appropriate within a range where no inconsistency occurs.

The example embodiments described so far will be collectively described hereinafter.

For example, a fan assembly disclosed herein may include a plurality of axial fans arranged in a first direction intersecting a rotation axis extending in an axial direction, a connector located on one side in the first direction with respect to the plurality of axial fans and electrically connects the plurality of axial fans and an external device, a chassis portion that accommodates the plurality of axial fans and the connector; and a first vibration-proof portion located on an outer surface of an end portion on the one side in the first direction of the chassis portion and protrudes outward (first configuration).

The fan assembly having the first configuration may be configured such that a plurality of the first vibration-proof portions are provided, and are located on at least either, among outer surfaces of end portions on one side in the first direction of the chassis portion: an end surface on one side and an end surface on the other side in a second direction perpendicular to the first direction; or an end surface on one side and an end surface on the other side in a third direction perpendicular to the first direction and the second direction (second configuration).

The fan assembly having the first or second configuration may be configured such that in the first direction, at least a portion of the first vibration-proof portion is located at the same position in the first direction as the position of the connector (third configuration).

The fan assembly having any of the first to third configurations may be configured to further include a second vibration-proof portion located on an outer surface of an end portion on the other side in the first direction of the chassis portion and protrudes outward (fourth configuration).

The fan assembly having the fourth configuration may be configured such that a plurality of the second vibration-proof portions are provided, and are located on at least either, among outer surfaces of end portions on the other side in the first direction of the chassis portion: an end surface on one side and an end surface on the other side in a second direction perpendicular to the first direction; or an end surface on one side and an end surface on the other side in a third direction perpendicular to the first direction and the second direction (fifth configuration).

The fan assembly having the fourth or fifth configuration may be configured such that the chassis portion includes a third side wall portion that is located on the other side in the first direction with respect to the plurality of axial fans and extends in a direction intersecting the first direction, and a handle located on the other side in the first direction with respect to the third side wall portion at an end portion on the other side in the first direction of the chassis portion, in the first direction, at least a portion of the first vibration-proof portion is located at the same position in the first direction as the position of the connector, and in the first direction, at least a portion of the second vibration-proof portion is located at the same position in the first direction as the position of the third side wall portion (sixth configuration).

The fan assembly having any of the first to sixth configurations may be configured to further include a third vibration-proof portion at least partially provided between the axial fan and the chassis portion in the axial direction and a fourth direction perpendicular to the first direction (seventh configuration).

The fan assembly having the seventh configuration may be configured such that the chassis portion includes a bottom wall portion located on a ventilation port side of each of the plurality of axial fans, extending in a direction intersecting the rotation axis, and having an opening connected to the ventilation port of each of the axial fans, a first side wall portion located on one side in the fourth direction with respect to the plurality of axial fans, the first side wall extending in the axial direction parallel to the rotation axis and the first direction, and a second side wall portion located on the other side in the fourth direction with respect to the plurality of axial fans, the second side wall extending in the axial direction parallel to the rotation axis and the first direction, and at least one of the first side wall portion and the second side wall portion is a different body from the bottom wall, and is attached to an end portion in the fourth direction of the bottom wall (eighth configuration).

The fan assembly having the eighth configuration may be configured such that the third vibration-proof portion is located at least between the axial fan and the first side wall portion and between the axial fan and the second side wall portion (ninth configuration).

The fan assembly having the eighth or ninth configuration may be configured such that the chassis portion further includes an attachment portion to which at least one of the first side wall portion and the second side wall portion is attached, and at least a portion of the attachment portion extends in the axial direction from an end portion in the fourth direction of the bottom wall portion (tenth configuration).

The fan assembly having the tenth configuration may be configured such that the axial fan includes a cylindrical housing extending in the axial direction, and the attachment portion extending from the bottom wall portion overlaps a space between the housings of the axial fans adjacent to each other in the first direction when viewed from the fourth direction (eleventh configuration).

Example embodiments of the present disclosure are useful for a fan assembly including an axial fan.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A fan assembly comprising:

a chassis portion; and a plurality of axial fans arrayed in the chassis portion along a first direction which is perpendicular to an axial direction of each of the plurality of axial fans; wherein the chassis portion includes a center portion, a first side portion on one lateral side of the center portion along the first direction, and a second side portion on another lateral side of the center portion along the first direction;

the fan assembly further includes a connector located closer to an outermost surface of the first side portion than the plurality of axial fans is, the connector electrically connecting the plurality of axial fans and an external device;

a pair of first vibration-proof portions are respectively located on opposing portions of an outer surface of an end portion of the chassis portion on the first side portion and protruding outward, the first vibration-proof portions suppressing transmission of vibration from the fan assembly;

four second vibration-proof portions are located on pairs of opposing portions on the outer surface of the end portion on the second side portion and protruding outward, the four second vibration-proof portions suppressing transmission of vibration from the fan assembly; and a handle is located on the second side portion, the handle including a grip portion which protrudes out from an outermost surface on an end portion on the second side portion in the first direction;

the opposing portions of the outer surface of the end portion of the chassis portion on the first side portion are opposed to one another in one of a second direction perpendicular to the first direction and a third direction perpendicular to both the first direction and the second direction; and the pairs of opposing portions on the outer surface of the end portion on the second side portion are respectively opposed to one another in the second direction and the third direction.

2. The fan assembly according to claim 1, wherein at least a portion of the pair of first vibration-proof portions is located adjacent to a position of the connector in the first direction.

3. The fan assembly according to claim 1, wherein the chassis portion includes:

a third side wall portion located closer to the second side portion in the first direction than the plurality of axial fans is, the third side wall portion extending in a direction intersecting the first direction; and in the first direction, at least a portion of the pair of first vibration-proof portions is located adjacent to a position of the connector; and in the first direction, at least a portion of the second vibration-proof portions is located adjacent to a position of the third side wall portion.

4. The fan assembly according to claim 1, further comprising a third vibration-proof portion at least partially located between the axial fan and the chassis portion in the axial direction and a fourth direction perpendicular to the first direction.

5. The fan assembly according to claim 4, wherein the chassis portion includes:

a bottom wall portion located on a ventilation port side of the plurality of axial fans, extending in a direction intersecting the rotation axis, and including an opening connected to the ventilation port of each of the plurality of axial fans;

a first side wall portion located away from the plurality of axial fans in the fourth direction, the first side wall portion extending in the axial direction parallel to the rotation axis and the first direction; and a second side wall portion located opposite from the first side wall portion in the fourth direction with the plurality of axial fans being located between the first side wall portion and the second side wall portion, the second side wall portion extending in the axial direction parallel to the rotation axis and the first direction; and at least one of the first side wall portion and the second side wall portion is a different body from the bottom wall, and is attached to an end portion of the bottom wall in the fourth direction.

6. The fan assembly according to claim 5, wherein the third vibration-proof portion is located at least between the axial fan and the first side wall portion and between the axial fan and the second side wall portion.

7. The fan assembly according to claim 5, wherein the chassis portion further includes an attachment portion to which at least one of the first side wall portion and the second side wall portion is attached, and at least a portion of the attachment portion extends in the axial direction from an end portion of the bottom wall portion in the fourth direction.

8. The fan assembly according to claim 7, wherein the axial fan includes a cylindrical housing extending in the axial direction, and the attachment portion extending from the bottom wall portion overlaps a space between the housings of the axial fans adjacent in the first direction when viewed from the fourth direction.

9. The fan assembly according to claim 1, wherein the pair of first vibration-proof portions includes one or more of a spring, a foam portion, or an elastic portion.

10. The fan assembly according to claim 1, wherein a longest dimension of the connector extends in one of the second direction perpendicular to the first direction and the third direction perpendicular to both the first direction and the second direction.

* * * * *